United States Patent [19]

Jackson et al.

[11] 4,222,361

[45] Sep. 16, 1980

[54] HAND HELD DISK LAUNCHER

[76] Inventors: Clifton E. Jackson, 8432 Snowden Pl., Laurel, Md. 20811; Ronnie L. Kinsley, 5451 Watercress Pl., Columbia, Md. 21045

[21] Appl. No.: 871,789

[22] Filed: Jan. 24, 1978

[51] Int. Cl.[2] ..... F41B 3/00

[52] U.S. Cl. ..... 124/5; 124/42; 124/35 R

[58] Field of Search ..... 124/5, 35 R, 41 R, 42, 124/31; 43/19, 86, 87; 46/74 R, 79, 220; 294/31.2, 19; 24/115 H, 115 CH; 119/153

[56] References Cited

U.S. PATENT DOCUMENTS

| | | | |
|---|---|---|---|
| 3,292,591 | 12/1966 | Wood | 294/19 R X |
| 3,402,959 | 9/1968 | Harris | 294/19 R |
| 3,537,438 | 11/1970 | Reed | 124/5 |
| 3,540,769 | 11/1970 | Rosser | 294/19 R |
| 3,901,208 | 8/1975 | Laporte et al. | 124/5 |

FOREIGN PATENT DOCUMENTS

| | | | |
|---|---|---|---|
| 163645 | 6/1958 | Sweden | 124/5 |
| 276973 | 3/1928 | United Kingdom | 124/5 |

*Primary Examiner*—William R. Browne

*Attorney, Agent, or Firm*—Sixbey, Friedman & Leedom

[57] ABSTRACT

A hand held launching apparatus for throwing aerodynamically stabilized disks with greater control and accuracy including an elongated handle, having a proximal and distal end, a flexible strap connected with the distal end of the handle for encircling the disk and a manually operated release mechanism operable at the proximal end of the handle for precisely controlling release of the object. The flexible strap may be mounted in a variety of configurations with respect to said handle as long as the strap applies an even retaining force over substantially the entire perimeter of the object being thrown. Rotation imparting structure, such as a friction increasing surface on the inside of the flexible strap, is disclosed for increasing the rotational component of velocity imparted to the object when thrown by the launcher.

13 Claims, 6 Drawing Figures

18
18
10
8
6
14
12
14
1a
1a
16
30
34
36
26
32
24
2
20
22
28
4

16
8
a
10
18
b 16
8
10
34
38
34
36
8
26
16
42
40
10
18
10
32
12
6
14
24
22
28
30
2
8
4

Fig 3.
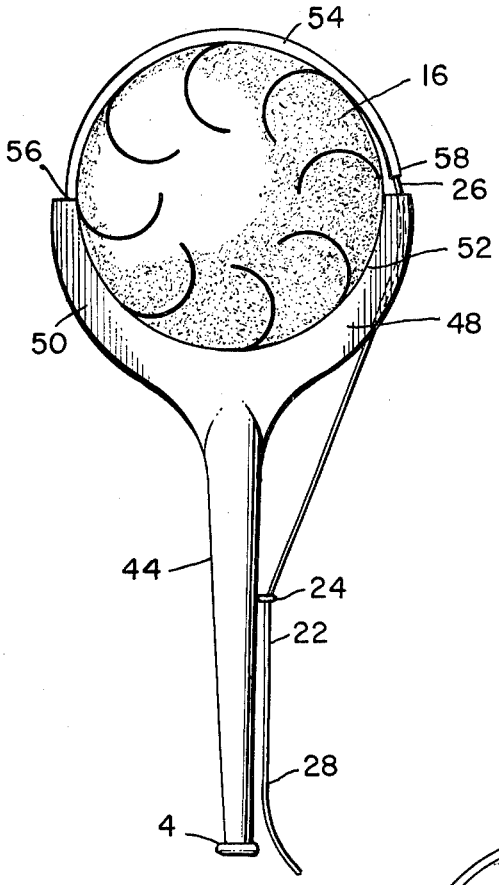
Fig 4.
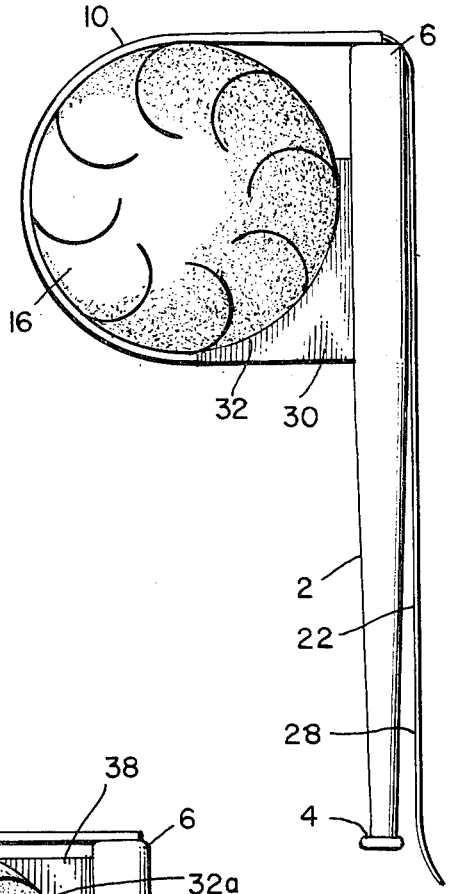
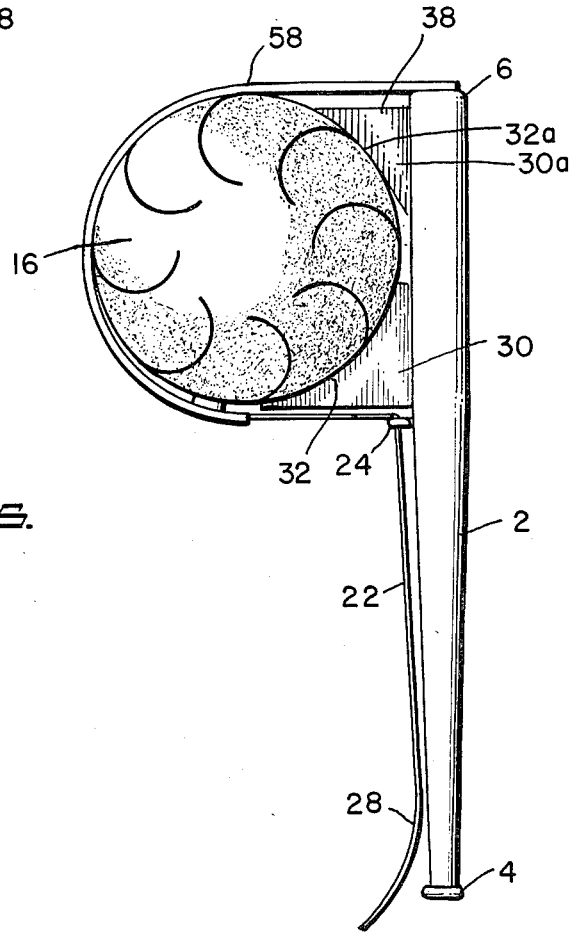
Fig 5.

HAND HELD DISK LAUNCHER

BACKGROUND OF THE INVENTION (1) Field of the Invention

This invention relates to an amusement method and apparatus for throwing an object such as a flying disk by means of a hand held launching device.

(2) Prior Art

Amusement games involving the throwing of aerodynamically stabilized disks of the type sold under the trademark FRISBEE by the Wham-O Corporation and under the trademark ALL STAR by Concept Products Incorporated and by many others, have enjoyed and continue to enjoy phenomenal popularity. However, some users have experienced difficulties in mastering the basic skills which are necessary for throwing such disks due to an inability to develop a viable throwing technique which often involves difficulties in grasping the disk and/or developing the proper wrist and arm motions required for an effective throw. Other users have been frustrated in their desire to obtain greater distances and accuracy; while more sophisticated techniques such as right and left hand long distance throwing is beyond the reach of all but the most skilled and dedicated. These limitations are due in part to the necessity of forming the disks out of light weight, small gauge material such as plastic and of shaping the disks in such a way as to impart the desired aerodynamic characteristics by which the disk appears to float or to be suspended in air as it is thrown. If the disks could be made smaller and of higher density material, greater distances and accuracy could be easily obtained. Such an approach, however, is not possible as the desirable aerodynamic characteristics of the disk would thus be lessened or destroyed. Of course, a user could attempt to acquire the minimum necessary skills or to improve his throwing ability by extensive training and practice but such time consuming activity is not practical for the majority of users who are only casual participants.

In the sport of skeet shooting it is well known that airborne targets (i.e., clay pigeons) can be thrown over great distances by means of a manually operated, hand held launching apparatus. For example, U.S. Pat. No. 3,537,438 discloses a hand operated device for launching clay pigeons including a handle for increasing the effective length of a user's throwing arm and a resilient element carried on the handle for engaging a portion of the outer periphery of the pigeon being thrown. When the launching device is swung outwardly, the pigeon gains sufficient momentum to spread open the resilient element and release itself from the launcher. By virtue of the increased effective length of the thrower's arm, the pigeon travels over a much longer trajectory than if the pigeon had been thrown with bare hands. A spring clamp attached to the resilient element is disclosed in U.S. Pat. No. 3,537,438 for resiliently engaging the rim of the clay pigeon to impart a spin thereto as the pigeon is launched. Examples of other types of hand held launching devices for throwing disk-shaped objects are disclosed in U.S. Pat. Nos. 663,090; 1,186,098, 1,700,880; 2,124,738; and 3,901,208.

Devices for throwing objects for target shooting are naturally designed to provide the greatest possible speed but need not be designed for great accuracy as some variation in target trajectory may not only be tolerable but actually desirable in order to challenge better the shooter's abilities. Moreover, target launching devices which rely on the momentum of the target to cause automatic release of the object invariably employ jaw-like object retaining structure. This retaining structure resiliently contacts the target's perimeter at opposed points during the time that the target is released from the launcher. As long as the object is formed of relatively rigid material, this type of release mechanism causes no distortion in the shape of the object which would adversely affect the desired flight path of the object. Thus, launching devices of this type are satisfactory for launching objects such as rigid targets. However, when an amusement game is played which involves the throwing by one player of a light weight, semiflexible object designed to be caught by another player, such conventional hand held launching devices are unsatisfactory for both increasing the skill and range by which the players may throw the object and for providing the degree of flight control necessary to enable the receiving player to catch the object. In part, this unsuitability of conventional launchers stems from the fact that the object being thrown is released only upon gaining sufficient momentum to spread apart the retaining structure; thus, the thrower is unable to vary the amount of momentum imparted to the object except above a predetermined release momentum. Moreover, great skill is required to be able to position the launcher in the direction necessary to effect a desired flight path at the instant of release of the object when such release is not under the direct control of the thrower. Since most aerodynamically stabilized disks used in amusement games are formed of semirigid material, the retaining structure of conventional launchers would tend to cause distortion in the shape of such disks during release and, would thus, cause unpredictable flight paths. Conventional launchers are also unsuitable because a portion of the momentum imparted to an object is employed to operate the release mechanism and, thus, the object will not travel as great a distance as would an object released by a mechanism that does not decrease the object's momentum, all other factors being equal.

Amusement devices are known for launching a circular object wherein the object is released by hand without necessarily decreasing the object's momentum. For example, U.S. Pat. No. 3,464,155 discloses such a device for manipulating a hoop in which the user swings the launcher while gripping both the launcher and the hoop until release of the hoop is desired at which point the user releases his grip on the hoop. While useful for the purposes disclosed, the launcher illustrated in U.S. Pat. No. 3,464,155 could not impart significantly greater momentum to an aerodynamically stabilized disk than is possible by bare hand throwing since the effective length of the user's throwing arm is not increased due to the necessity for the user to grip both the launcher and the object during each throw.

SUMMARY OF THE INVENTION

It is an object of this invention to overcome the deficiencies of the prior art as noted above.

A more particular object of this invention is to provide method and apparatus for obtaining greater speed and trajectory control when throwing an object by an arm swinging motion.

Still another object of this invention is to enable uncoordinated or unskilled throwers of aerodynamically stabilized disks to master more easily the ability to throw such disks and to control accurately the flight path thereof.

Another object of this invention is to provide a hand held launching apparatus for obtaining greater speed and trajectory control when used to throw an object by arm swinging motion including an arm extension means in the form of an elongated handle for extending the effective length of the user's arm. The launching apparatus also includes an object retaining means in the form of a strap connected with the elongated handle and movable between first and second positions for retaining the object in a launching position with respect to the elongated handle when the strap is in the first position and for releasing the object when the strap is moved toward the second position. A manual release control means is further provided in the form of a flexible extension of the flexible strap positioned for engagement by the user's hand for maintaining the strap in the first position until the exact point in the swing at which release of the object is desired.

Another object of the subject invention is to provide a hand held launching apparatus including an elongated handle having a proximal end and a distal end, an object retaining means such as a strap, referred to above, movable between a first and second position for retaining the object in a launching position in which the object has a proximal side and a distal side with respect to the elongated handle when the strap is in the first position and for releasing the object when the strap is moved toward the second position. The strap is connected at one end to the elongated handle and, when in the first position, is wrapped substantially fully around the distal side of the object thereby to retain the object in launching position so long as the strap is retained in the first position such as by means of an extension thereof gripped by the throwing hand of the user. This arrangement permits the user to release the strap at the desired point in the swing of the launching apparatus thereby to permit the momentum gained by the object and the strap during the swing to move the strap toward the second position and thus release the object from the launcher.

Yet another object of the invention is to provide a launching apparatus as described above wherein the elongated handle is formed of a material which is substantially more rigid than the flexible strap thereby to permit substantial momentum to be imparted to the object being thrown while at the same time permitting the object to be easily released at a desired point in the swing.

A still more specific object of this invention is to provide a launching apparatus as described above designed to launch a disk-shaped object having an aerodynamically stabilizing rounded circumferential edge wherein the flexible strap referred to above is contoured to conform to the rounded edge of the disk-shaped object.

Yet another object of the subject invention is to provide a launching apparatus as described above including rotation imparting means such as highly frictional or adhesive material for engaging the edge of an object being launched, thereby to impart rotational movement to the object as it is released from the launching apparatus.

Still another object of this invention is to provide a method for obtaining greater speed and trajectory control when throwing an object by an arm swinging motion including the steps of connecting to the distal end of an elongated handle one end of a flexible strap having sufficient length to extend substantially around the object to be thrown, providing a flexible extension on the free end of the flexible strap sufficient in length to reach the proximal end of the elongated handle, securing an object in a launching position with respect to the elongated handle by wrapping the strap around the object and gripping the extension and the proximal end of the elongated handle with one or both hands, swinging the elongated handle to impart momentum to the object and releasing the flexible extension at the desired time during the swing while continuing to grip the handle so as to cause the flexible strap to be unwrapped by its own momentum and by the momentum of the object.

Other objects and advantages of the subject invention will be apparent from the following description of the drawings and the detailed description of the preferred embodiment.

SUMMARY OF THE DRAWINGS

FIG. 3 is a side elevational view of another embodiment of the subject invention including an elongated handle having a Y-shaped, distal end, FIG. 4 is a side elevational view of still another embodiment of the subject invention wherein the flexible strap for retaining the object being thrown is wrapped substantially fully around the object, and FIG. 5 is a side elevational view of still another embodiment of the subject invention wherein one end of a flexible strap used to hold an object being thrown is connected to the distal end of the launcher.

DESCRIPTION OF THE PREFERRED EMBODIMENTS

Figure 1:
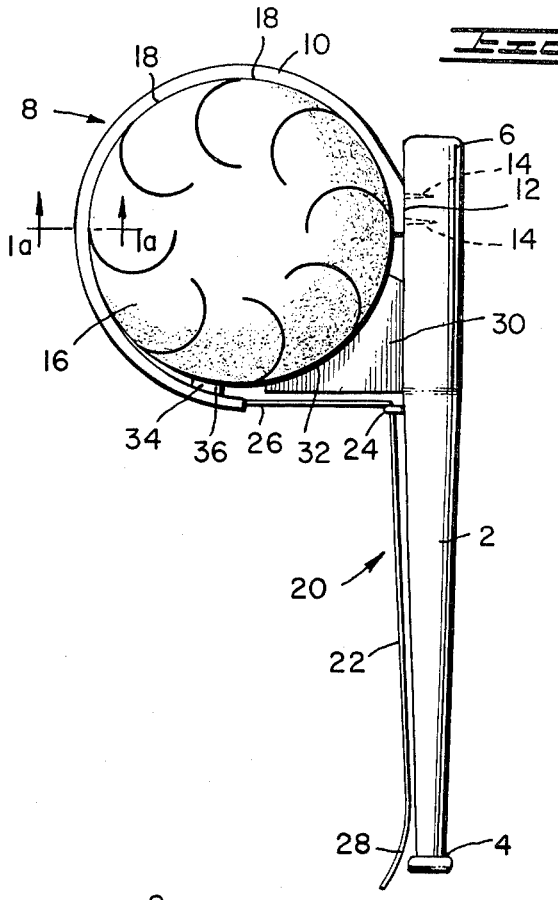
FIG. 1 is a side elevational view of a hand held launching apparatus designed in accordance with the subject invention.

A hand held launching apparatus designed in accordance with the subject invention is illustrated in FIG. 1 including an elongated handle 2 having a proximal end 4 adapted to be gripped by one or both of the user's hands and a distal end 6. Elongated handle 2 constitutes an arm extension means for extending the effective length of the user's arm as will be more fully understood when the method for using the subject apparatus is described in detail hereinbelow.

Figure 2:
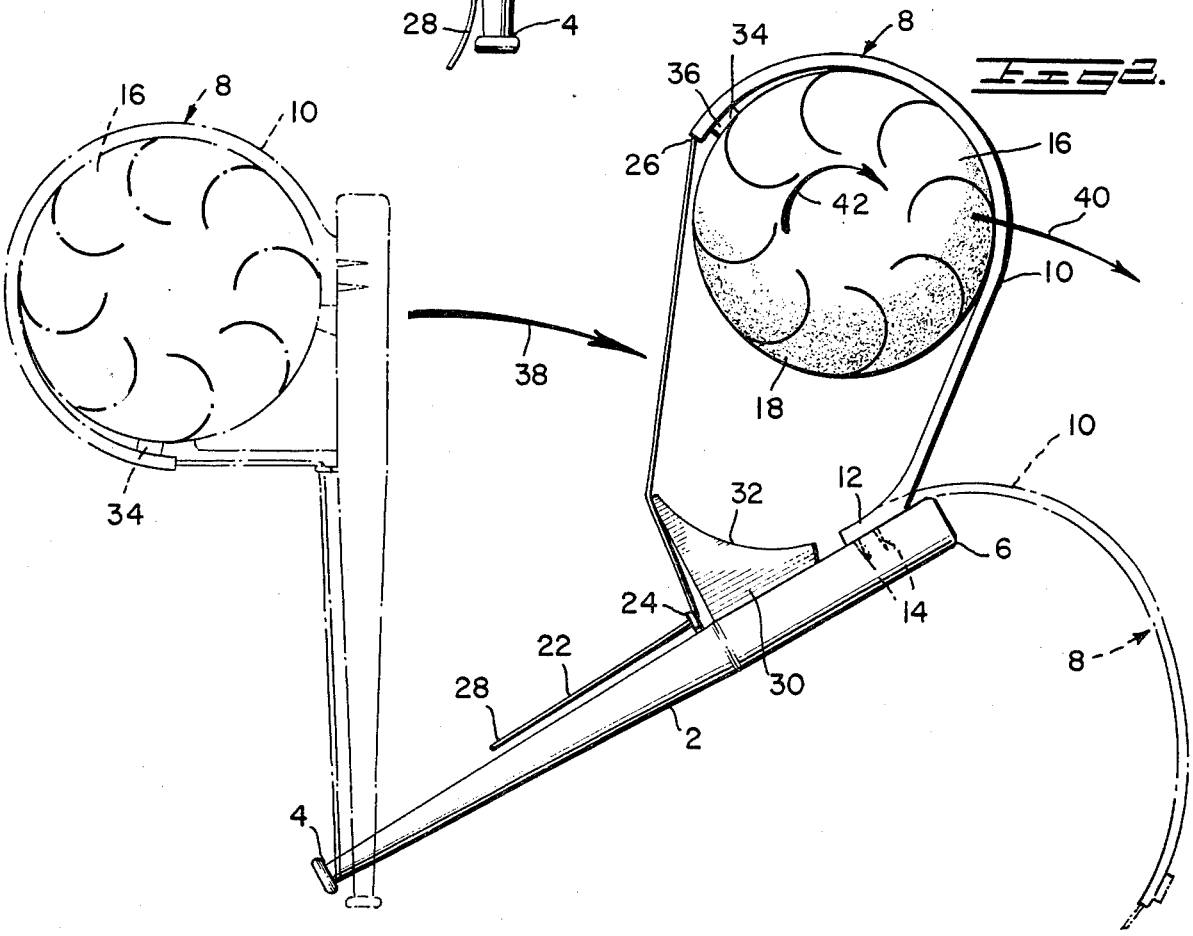
FIG. 2 is a side elevational view of the launching apparatus of FIG. 1 wherein the object being thrown is in the process of being released from the launcher.

FIG. 1 also illustrates an object retaining means 8 movable between a first position illustrated in solid lines to a second position illustrated in dashed lines in FIG. 2. The object retaining means includes a uniplanar flexible strap 10 (i.e., flexible in the plane defined by the disk and relatively inflexible in directions out of the plane of the disk) connected at one end 12 to the distal end of the elongated handle 2 by means of rivets 14 or other suitable fasteners. The other end of the flexible strap 10 is free to move as the object retaining means moves between the first and second positions. In particular, strap 10 may be wrapped about the perimeter of the object 16 being thrown so as to retain the object in a launching position relative to the elongated handle 2.

In the embodiment illustrated in FIG. 1, the object 16 is disk-shaped and has an aerodynamically stabilizing, rounded circumferential edge 18. One example of such a disk-shaped object is sold under the trademark FRISBEE by the Wham-O Corporation. Such an object is formed of thin-gage plastic material in a shape so that upon being projected into the air with a rotational component of motion, the disk proceeds on a trajectory which gives the impression of floating or being suspended in air.

A manual release control means 20 in the form of a flexible string, wire or cable 22 is connected to the free end of the flexible strap 10 and extends to the proximal end 4 of the elongated handle 2 whereat it may be engaged by the user's hand and held there so as to maintain the object retaining means 8 in the first position until the exact point in the swing at which release of the object is desired. A hook or eyelet 24 is mounted on the elongated handle 2 between the proximal end 4 and the distal end 6 so as to receive the string 22 in sliding relationship, so that the portion 26 of the string immediately adjacent the free end of flexible strap 10 projects generally tangentially from the face end of strap 10 relative to the circumference of disk 16 whereas the remaining portion 28 of the string is arranged generally parallel to the longitudinal axis of the elongated handle 2. This arrangement of the string permits the object to be completely encircled by the strap 10 and to be held most securely by directing the component of the retaining force transmitted to the flexible strap 10 more nearly perpendicularly toward the elongated handle 2. The parallel arrangement of portion 28 relative to handle 2 permits simultaneous gripping of the string and handle to be accomplished more easily.

To obtain a secure engagement of the object with the elongated handle, the distal end of the handle may be contoured to conform to the shape of the perimeter of the object. In the case of a circular disk, a wedge shaped spacer 30 may be mounted on the handle having a curved portion 32 with a radius equal to the radius of the disk.

As noted above, it is well known that certain types of aerodynamically stable disks must be given a rotational component of motion in order to obtain the desired flight characteristics. The subject launcher is designed to impart such a rotational component of motion by the provision of means 34. While such means may take a variety of forms, it has been found to be sufficient merely to provide some type of friction inducing structure between the perimeter of object 16 and the inside surface of strap 10. For example, any type of material having a high coefficient of friction relative to the perimeter of object 16 could be coated or mounted on all or a portion of the inside surface of strap 10. Means 34 may also be formed of adhesive material 36 which releasably engages the perimeter of the disk-shaped object 16 to insure that as the strap 10 moves toward the second position, the disk 16 is caused to roll along the inside edge of the strap whereby those portions of the strap engaging the perimeter of the disk nearest the distal end of the elongated handle are the first portions of the strap to become disengaged with the perimeter of the disk while the free end of the strap at which the adhesive material is located, is the last portion of the strap to become disengaged from the perimeter of the disk. In this way, the disk is caused to "roll" along the inside surface of strap 10 as it unwinds thus imparting a very large rotational component of motion to the disk.

Figure 1A:
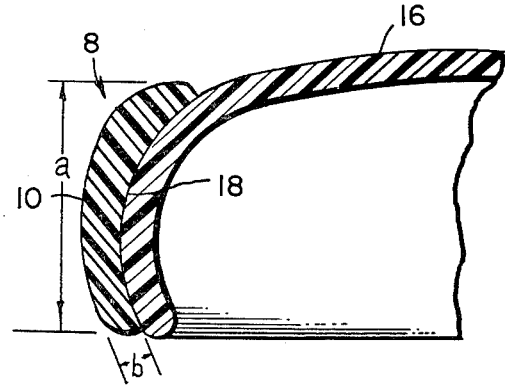
FIG. 1*a* is a partial cross sectional view of the launching apparatus of FIG. 1, taken along lines 1*a*—1*a*.

FIG. 1*a* discloses a partial cross sectional view of the disk 16 engaged by the flexible strap 10. As can be seen quite clearly from this view, flexible strap 10 has been contoured to complement the rounded, down turned perimeter of disk 16 to thereby permit the disk to be very securely held when the object retaining means 8 is in the first position.

To operate the disclosed launching apparatus, an object, such as a FRISBEE, is placed in the launching position illustrated in FIG. 1 and the flexible strap 10 is wrapped therearound as shown in solid lines. String 22 is fed through hook or eyelet 24 such that portion 28 may be gripped simultaneously around the proximal end 4 of the elongated handle 2. Dependent upon the user's own preferences, string 22, and the proximal end 4 may be held by only one or by both hands to permit the string to be released without losing a solid grip on handle 2. The launcher may now be swung so as to impart the desired momentum to object or disk 16. At the desired instant in this swing, string 22 is released so as to cause the flexible strap 10 to be unwrapped by the momentum of the strap and object.

Immediately following release of the string 22, the launcher and object will have the configuration illustrated in FIG. 2 wherein flexible strap 10 has moved to an intermediate stage between the first position illustrated in solid lines in FIG. 1 to the second position illustrated in dashed lines in FIG. 2. Arrow 38 is indicative of the direction of movement of elongated handle 2 while arrow 40 is representative of the linear component of velocity of disk 16 resulting from the swinging motion of handle 2 followed by the release of string 22. A rotational component of motion is also imparted to disk 16 as illustrated by arrow 42.

The launching apparatus of FIGS. 1 and 2 includes an elongated handle 2 and flexible strap 10 formed separately and interconnected by some suitable fastener. As an alternative, the handle and flexible strap may be molded as an integral one piece unit, the only qualification being that the elongated handle be substantially more rigid than the flexible strap. This result may be effected by forming the elongated handle 2 with a greater thickness and with rigidifying ribs while strap 10 would be molded or formed with a thinner gage in such a manner that movement out of the plane of the disk would be resisted.

Still other variations of the subject launcher are illustrated in FIGS. 3–5. In particular, FIG. 3 illustrates an elongated handle 44 having a Y-shaped distal end including forked legs 48 and 50. The inside surface 52 of the forked legs 48 and 50 is curved to provide a complementary surface for engaging disk 16. Flexible strap 54, corresponding to strap 10 of the embodiment illustrated in FIGS. 1 and 2, is permanently connected to leg 50 at point 56 and is connected at the other end 58 to string 22. The embodiment of FIG. 3 would operate in the same manner as the embodiment illustrated in FIGS. 1 and 2 but would provide the capability of more accurately determining the direction of initial launching since the legs 48 and 50 would cooperate generally to require the disk 16 to leave the elongated handle 44 along the longitudinal axis of the handle.

The embodiment of FIG. 4 is very similar to the embodiment of FIGS. 1 and 2 with the exception that flexible strap 10 is connected to the wedge shaped spacer 30 and is wrapped around disk 16 in a clockwise direction as illustrated in FIG. 4 with string 22 being placed over the distal end 6 of the elongated handle 2. String 22 proceeds then along the entire length of the elongated handle 2 to the proximal end 4. This embodiment of the invention eliminates the possible need for hook or eyelet 24 while at the same time permitting string 22 to be positioned parallel to the longitudinal axis of elongated handle 2.

FIG. 5 illustrates yet another embodiment of the subject invention wherein a flexible strap 58 is connected directly to the distal end 6 of elongated handle 2. A second spacer 30*a* similar to spacer 30 is attached to the extreme distal end of handle 2 with a curved surface 32*a* contoured to complement a portion of the perimeter of object 16 which in the case of a circular disk would be an arc having a radius equal to the outside radius of the disk. As with the embodiment of FIG. 3, this arrangement of spacers provides for a more controlled release of the object being thrown.

Figure 6:
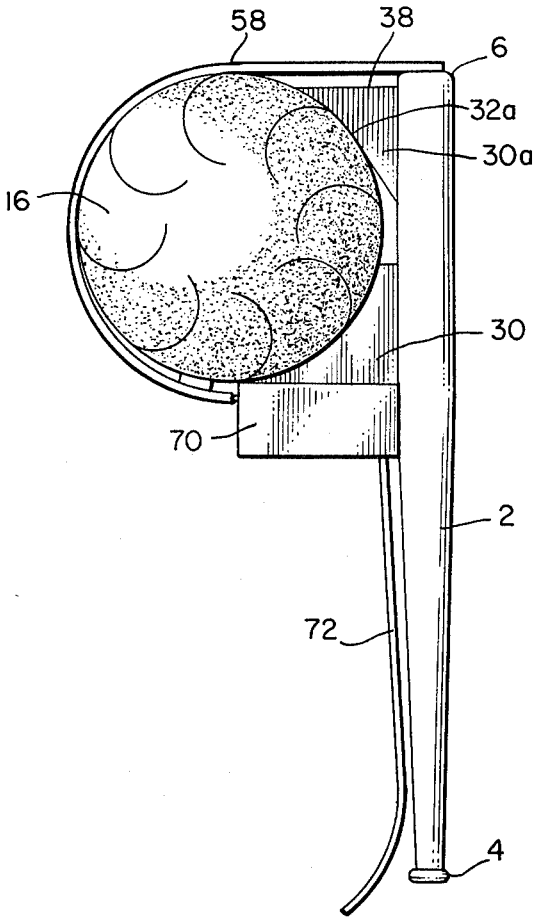

Numerous additional variations in the disclosed launcher are also possible. For example, as illustrated in FIG. 6, the wire or string 22 may be replaced by a hook release mechanism 70 mounted on handle 2 for engaging the free end of strap 10 which has been modified for engagement with the release mechanism. By providing an operator linkage 72 between the proximal end 4 of handle 2 and the hook release mechanism 70, the user could still very accurately control release of the strap while avoiding any possibility that the object would come into contact with a string upon being released from the launcher. Still another variation of the release mechanism would be to provide an automatically operated release such as by the provision of a "ball and socket" mechanism wherein a resilient socket could be mounted on either the handle or a flexible extension of strap 10 while a mating ball would be mounted on the other element so that upon engagement of the ball and socket, strap 10 would be held in the first position described above. Upon gaining proper momentum, the forces in strap 10 would be such as to cause the ball to be released from the socket. While this arrangement would not accomodate precise manual actuation of the object release mechanism, the other benefits of the disclosed launcher discussed above would be retained such as the capability of applying an even continuous retaining force on the entire perimeter of the object being thrown by means of a flexible strap which extends around the entire perimeter of the object. Moreover, the advantage of uniplanar motion of the strap could also be retained whereby the strap is made relatively flexible only in the plane of the object being thrown. While a strap having a broad width (distance "a" as illustrated in FIG. 1*a*) relative to the strap thickness ("b" FIG. 1*a*) would tend to have this characteristic, a guide structure could be mounted on the handle 2 to insure such uniplanar motion of strap 10.

The length of elongated handle 2 could also be varied from 12 inches up to 4 feet or more dependent upon the type and weight of object being thrown. For example, for a light weight FRISBEE such as the 89 gm model, a shorter length, lighter weight launcher might be preferable while a longer, 18 inch to 36 inches, launcher might be preferable for the 119 gm FRISBEE. The handle may also be bent in shape rather than straight to accommodate different styles and techniques of throwing.

Still other variations of the disclosed design would of course occur to one of ordinary skill in the art upon review of the above disclosure. The benefits and advantages of the subject invention are now evident from the above description.

We claim:

1. A hand held launching apparatus for obtaining greater speed and trajectory control with greater ease when used to throw an object by an arm swinging motion, comprising (a) arm extension means for extending the effective length of the user's arm, said arm extension means including an elongated handle having a proximal end and a distal end;

(b) object retaining means movable between a first condition for retaining the object in a launching position in which the object has a proximal side and a distal side and the object is fixed with respect to said elongated handle and a second condition for releasing the object from said elongated handle when said object retaining means is moved to the second condition, said object retaining means includes a flexible strap having one end permanently connected to the distal end of said elongated handle and being wrapped substantially fully around the distal side of the object when said object retaining means is in said first condition; and (c) rotation imparting means connected with said object retaining means for imparting rotational movement to an object being launched.

2. A launching apparatus as defined in claim 1, wherein said rotation imparting means includes adhesive means for releasibly engaging the perimeter of the object when said object retaining means is in said first position.

3. A launching apparatus as defined in claim 1, wherein said rotation imparting means includes friction increasing means for increasing the co-efficient of sliding friction between the inside surface of said strap and the perimeter of an object engaged by said strap.

4. A hand held launching apparatus for obtaining greater speed and trajectory control with greater ease when used to throw a disk-shaped object having a smoothly rounded, continuously uninterrupted circumferential edge, comprising (a) arm extension means for extending the effective length of the user's arm, said arm extension means including an elongated handle having a proximal end and a distal end; and (b) object retaining means for retaining the object in a launching position in which the object has a proximal side and distal side with respect to said elongated handle and for controllably releasing the object during a swing of said elongated handle, said object retaining means including a flexible strap connected at one end to said elongated handle and movable from a retaining position in which said flexible strap is wrapped fully around the distal side of the object in contact with at least one half of the circumferential edge of the object and in which the longitudinal axis of said strap resides within an object retaining plane, said flexible strap being movable toward an object releasing position in which the disk is released as said elongated handle is swung, said flexible strap being formed to be more resistant to forces which cause the longitudinal axis of the strap to move out of the object retaining plane than to forces which cause the longitudinal axis to remain in the object retaining plane, whereby said strap tends to follow an uniplanar path in moving from said retaining position to said releasing position, wherein said elongated handle is contoured at the distal end thereof to match a portion of the perimeter of the object being launched and said contoured end of said elongated handle has a radius of curvature equal to the disk-shaped object, wherein said elongated handle has a "Y" shape and said contoured distal end includes an arcuate surface formed between the forked legs of said "Y" shaped elongated handle.

5. A hand held launching apparatus for obtaining greater speed and trajectory control with greater ease when used to throw a disk-shaped object having a smoothly rounded, continuously uninterrupted circumferential edge, comprising (a) arm extension means for extending the effective length of the user's arm, said arm extension means including an elongated handle having a proximal end and a distal end; and (b) object retaining means for retaining the object in a launching position in which the object has a proximal side and a distal side with respect to said elongated handle and for controllably releasing the object during a swing of said elongated handle, said object retaining means including a flexible strap connected at one end to said elongated handle and movable from a retaining position in which said flexible strap is wrapped fully around the distal side of the object in contact with at least one half of the circumferential edge of the object and in which the longitudinal axis of said strap resides within an object retaining plane, said flexible strap being movable toward an object releasing position in which the disk is released as said elongated handle is swung, said flexible strap being formed to be more resistant to forces which cause the longitudinal axis of the strap to move out of the object retaining plane than to forces which cause the longitudinal axis to remain in the object retaining plane, whereby said strap tends to follow an uniplanar path in moving from said retaining position to said releasing position, further including manual release control means positioned to engage both said flexible strap and the user's hand for maintaining said flexible strap in said object retaining position until the exact point in the swing at which release of the object is desired, wherein said manual release control means includes a strap engaging means mounted on said elongated handle for releasably engaging the free end of said strap when said strap is in said retaining position and control linkage means extending between said strap engaging means and the proximal end of said elongated handle for allowing the free end of said strap to be released from said strap engaging means by actuation of the control linkage means of the proximal end of said elongated handle.

6. A hand held launching apparatus for obtaining greater speed and trajectory control with greater ease when used to throw a disk-shaped object having a smoothly rounded, continuously uninterrupted circumferential edge, comprising (a) arm extension means for extending the effective length of the user's arm, said arm extension means including an elongated handle having a proximal end and a distal end; and (b) object retaining means for retaining the object in a launching position in which the object has a proximal side and a distal side with respect to said elongated handle and for controllably releasing the object during a swing of said elongated handle, said object retaining means including a flexible strap connected at one end to said elongated handle and movable from a retaining position in which said flexible strap is wrapped fully around the distal side of the object in contact with at least one half of the circumferential edge of the object and in which the longitudinal axis of said strap resides within an object retaining plane, said flexible strap being movable toward an object releasing position in which the disk is released as said elongated handle is swung, said flexible strap being formed to be more resistant to forces which cause the longitudinal axis of the strap to move out of the object retaining plane than to force which cause the longitudinal axis to remain in the object retaining plane, whereby said strap tends to follow an uniplanar path in moving from said retaining position to said releasing position, wherein said flexible strap has a thickness, measured within said object retaining plane, which is substantially less than the lateral width of said flexible strap measured perpendicularly to said object retaining plane.

7. A launching apparatus as defined in claim 6, further including manual release control means positioned to engage both said flexible strap and the user's hand for maintaining said flexible strap in said object retaining position until the exact point in the swing at which release of the object is desired.

8. A launching apparatus as defined in claim 7, wherein said proximal end of said elongated handle is suitable to be gripped by the user's hand and said release control means includes a flexible extension of said flexible strap sufficiently long to be held by the same hand being used to grip said proximal end of said elongated handle.

9. A launching apparatus as defined in claim 8, wherein said elongated handle includes a flexible extension retainer means mounted between the proximal and distal ends of said elongated handle for causing the flexible extension to be arranged parallel to said elongated handle adjacent the proximal end thereof and for allowing the flexible extension to be pulled in a direction along said elongated handle as said object retaining means is moved from said object retaining position to said object releasing position.

10. A launching apparatus as defined in claim 6, wherein said elongated handle is formed of material which is substantially more rigid than said flexible strap.

11. A launching apparatus as defined in claim 6, wherein said elongated handle is contoured at the distal end thereof to match a portion of the perimeter of the object being launched.

12. A launching apparatus as defined in claim 11, wherein said contoured end of said elongated handle has a radius of curvature equal to the disk-shaped object.

13. A launching apparatus as defined in claim 6 for use with a disk shaped object having a cross sectional circumferential edge configuration, taken within a plane perpendicular to the plane of the disk, which is rounded, wherein said flexible strap is contoured to conform to the shape of the rounded circumferential edge of the object in a direction perpendicular to said object retaining plane.

* * * * *